United States Patent [19]

Komatsuta et al.

[11] 4,305,521

[45] Dec. 15, 1981

[54] BEVERAGE CONTAINER WITH A STRAW

[76] Inventors: Hiroshi Komatsuta, 34-10 Shirahagi-cho; Shigesato Onodera, 3-48-102 Kashiwagi 2-chome, both of Sendai, Japan

[21] Appl. No.: 183,324

[22] Filed: Sep. 2, 1980

Related U.S. Application Data

[63] Continuation of Ser. No. 61,193, Jul. 27, 1979, abandoned.

[30] Foreign Application Priority Data

Mar. 26, 1979 [JP] Japan ..... 54-39448
Mar. 26, 1979 [JP] Japan ..... 54-39449

[51] Int. Cl.[3] ..... A47G 19/22
[52] U.S. Cl. ..... 220/90.2; 229/7 S
[58] Field of Search ..... 220/90.2, 90.4, 90.6; 229/7 S; 215/1 A

[56] References Cited

U.S. PATENT DOCUMENTS

| | | | |
|---|---|---|---|
| 3,656,645 | 4/1972 | Brinkley | 229/7 S |
| 3,776,458 | 12/1973 | Chunga | 215/1 A |
| 3,946,895 | 3/1976 | Pash | 229/7 S |
| 4,078,692 | 3/1978 | Stein | 220/90.2 |
| 4,109,817 | 8/1978 | Payne | 220/90.2 |

*Primary Examiner*—George E. Lowrance
*Attorney, Agent, or Firm*—George B. Oujevolk

[57] ABSTRACT

A beverage container is disclosed which includes an upper end closure formed with a pour opening, a cover panel removably attached to the end closure to close the pour opening, a straw provided in the container for popping movement through the pour opening, and a retainer holding the straw in place. The retainer may be taken in the form of a pin- or L-shaped projection attached to the cover panel. The straw is formed in its upper portion with a stretchable portion and provided on its lower portion with a float.

3 Claims, 6 Drawing Figures

1
2a
2b
3
4
5
6
6a
7
8
8a
8b
11
11a
11b
12
A
A
ℓ

BEVERAGE CONTAINER WITH A STRAW

This is a continuation of application Ser. No. 61,193 filed July 27, 1979 now abandoned.

BACKGROUND OF THE INVENTION

1. Field of the Invention

This invention relates to beverage containers for containing beverages such as beer, soft drinks and the like and, more particularly, to beverage containers including an end closure formed with a pour opening normally covered with a cover panel, and a straw retained therein for outward popping movement through the pour opening when the cover panel is removed.

2. Description of the Prior Art

Various beverage containers have already been in extended use, but prior beverage containers have had serious disadvantages such as lack of hygienic care resulting from the practice wherein drink containers have their pour opening sides directly placed on ground and wiped off with a dirt dustcloth before they are charged in an automatic vending machine.

One approach in eliminating such disadvantages has been to provide a container structure with a straw set therein as disclosed in Japanese Utility Model Registration Publication No. 51-22031. The container structure comprises a cover panel, an upright straw fixed on the inner surface of the container, a first tube having its one end rotatably mounted to the cover panel and provided with a suction opening, and a second tube intersecting with the first tube and provided at its tip end with a sharpened opening portion so that the sharpened opening portion is fitted in the upper opening end of the straw when the second tube is rammed against the cover panel just above the straw to form a hole therein. However, such a conventional container structure requires some manipulations to rotate the first tube and ram the second tube against the cover panel upon drinking of the beverage contained in the container. Additionally, it requires a number of operations to manufacture beverage containers which results in high manufacture cost.

SUMMARY OF THE INVENTION

It is therefore one object of the present invention to provide a beverage container which permits drinking with great elegance and hygienic care.

Another object of the present invention is to provide a beverage container which includes a very simple and effective retainer for holding a straw in place.

Another object of the present invention is to provide a beverage container which permits drinking with great pleasure.

Still another object of the present invention is to provide a beverage container which includes a straw retainer permitting easy removal of the straw provided in the container when desired.

A further object of the present invention is to provide a beverage container in which a straw is popped outward to allow immediate drinking when the container is open.

Other objects, means, and advantages of the present invention will become apparent to one skilled in the art thereof from the following description.

BRIEF DESCRIPTION OF THE DRAWINGS

The following explanation of several preferred embodiments of the present invention will help in the understanding thereof, when taken in conjunction with the accompanying drawings, which, however, should not be taken as limiting the present invention in any way, but which are given for purposes of illustration only. In the drawings, like parts are denoted by like reference numerals, and.

DESCRIPTION OF THE PREFERRED EMBODIMENTS

Figures 1, 2, 3:
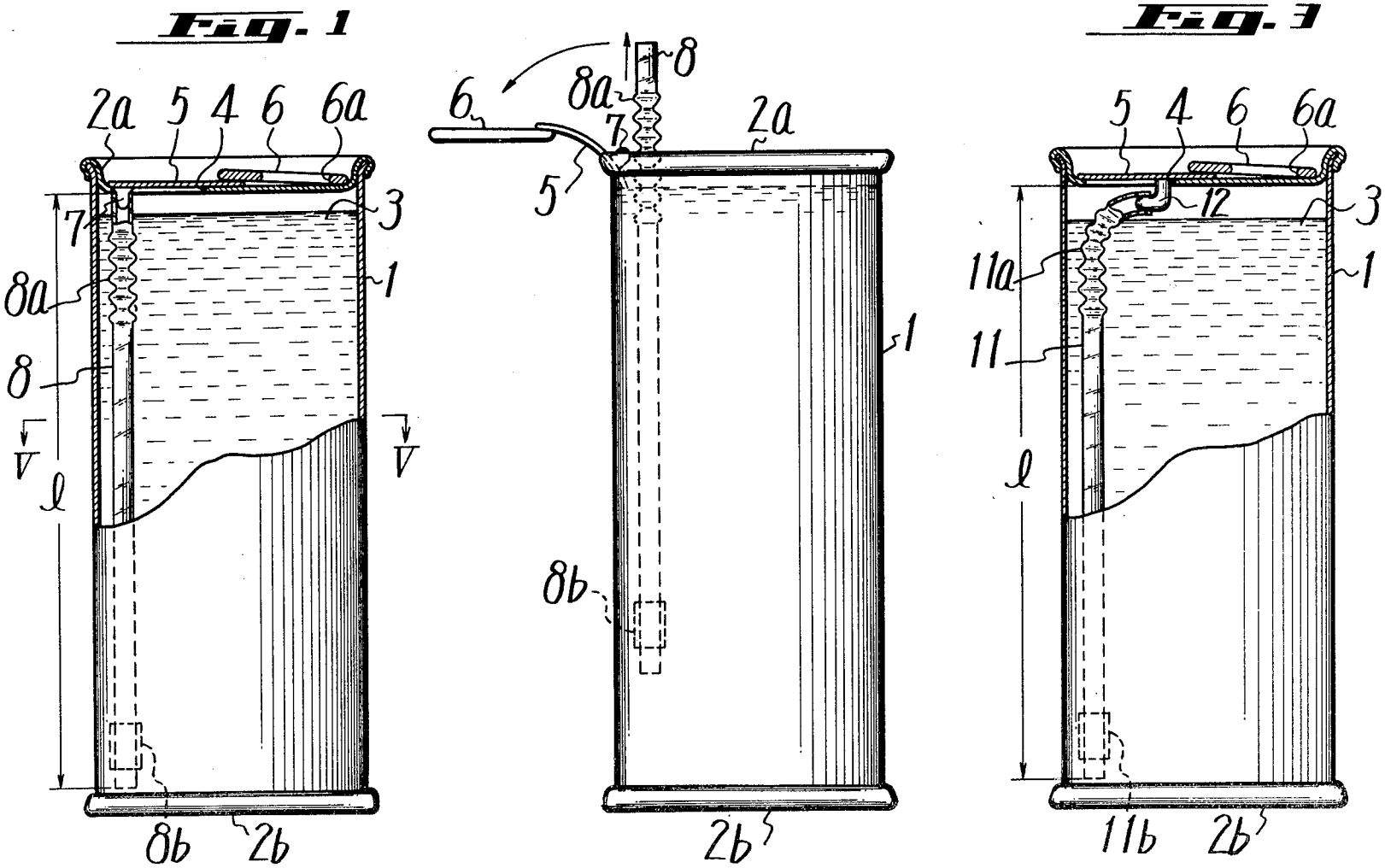
FIG. 1 is a view partly in elevation and partly in section showing a beverage container made in accordance with the present invention.
FIG. 2 is an elevational view of the beverage container of FIG. 1 with the cover panel shown removed.
FIG. 3 is a view partly in elevation and partly in section showing a second embodiment of the present invention.

Referring now to FIGS. 1 and 2, there is illustrated one embodiment of a beverage container 1 made in accordance with the present invention. The container 1 includes a side wall having upper and lower end closures 2*a* and 2*b* attached thereto in the usual manner. The upper end closure 2*a* is formed with an elliptical pour opening 4 from which the beverage 3 contained in the container 1 can be discharged. The pour opening 4 is covered with a thin cover panel 5 removably attached to the upper end closure 2*a*. A tab 6 is spot welded or otherwise suitably connected to the cover panel 5 and formed with an aperture 6*a* such that a finger can be inserted in the aperture 6*a* in upwardly pulling the tab 6 to remove the cover panel 5 from the upper end closure 2*a*. The cover panel 5 has on its lower surface a pin-shaped projection 7 extending downwardly.

A straw 8 is placed in the container 1. The straw 8 is formed in its upper portion with a bellows 8*a* permitting the straw 8 to expand and contract and is provided on its lower portion with a float 8*b* made of material smaller in specific gravity than water. The pin-shaped projection 7 is fitted in the upper opening end of the straw 8 so as to retain the straw 8 in place. The straw 8 has a length substantially equal to the length l between the upper and lower end closures 2*a* and 2*b* when contained and contracted in the container 1 and has a length longer than the length l when the cover panel 5 is removed and the straw 8 pops through the pour opening 4. This is accomplished by the function of the bellows portion 8*a* of the straw 8.

As shown in FIG. 2, the straw 8 is released from the projection 7 and popped outwardly through the pour opening 4 so that the beverage 3 can be sucked through the straw 8 when the tab 6 is pulled upwardly to remove the cover panel 5 from the upper end closure 2*a*. The distance of the popping movement of the straw 8 varies depending on the depth and length of the container 1 and can be adjusted by the choise of the size of the float 8*b*.

Thus, the beverage container structure of the present invention permits drinking with great elegance and hygienic care and also with great pleasure if used in juvenile applications.

Figure 4:
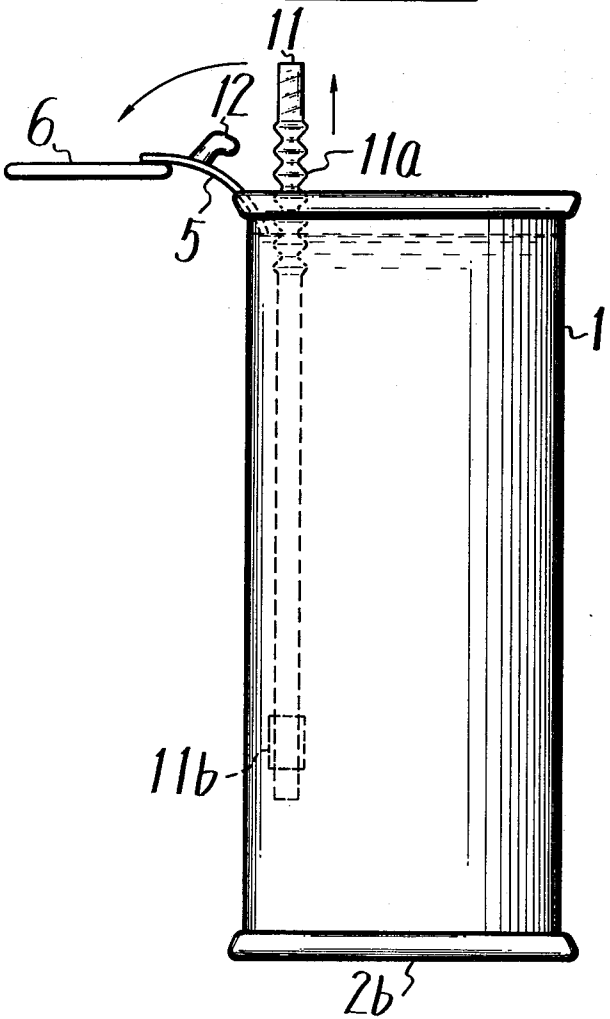
FIG. 4 is an elevational view of the beverage container of FIG. 3 with the cover panel shown removed.

Referring to FIGS. 3 and 4, there is illustrated a second embodiment of the present invention, in which reference numeral 11 designates a straw formed in its upper portion with a bellows 11*a* and provided on its lower portion with a float 11*b* made of material having a specific gravity smaller than water. The cover panel 5 is formed on its lower surface with a L-shaped projection 12 which is fitted in the upper opening end of the straw 11 turned at its bellows portion 11*a* so as to retain the straw 11 in place.

As shown in FIG. 4, the straw 11 is released from the projection 12 and popped outwardly through the pour opening 4 so that the beverage 3 can be sucked through the straw 11 when the tab 6 is pulled upwardly to remove the cover panel 5 from the upper end closure 2*a*. Accordingly, the second embodiment can provide the same effect as described in connection with the first embodiment of FIGS. 1 and 2.

Figure 5:
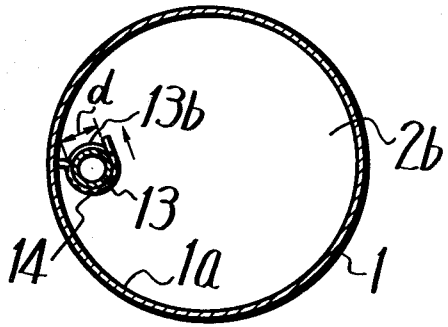
FIG. 5 is a transverse sectional view through the straw retainer.

Referring to FIG. 5, there is illustrated a third embodiment of the present invention. In this embodiment, the straw 13 is retained in place by a retainer 14 turned to have a hook-shaped cross section with an inner diameter slightly larger than the diameter d of the straw 13 and attached to the inner surface of the container 1. The free end of the retainer 14 is open to allow easy removal of the straw 13 from the retainer 14 by movement of the straw 13 in the arrow direction if it becomes unnecessary. When the straw 13 is moved longitudinally, the float 13*b*, provided on the lower portion of the straw 13, abuts against the retainer 14 so as to prevent the straw 13 from coming off the retainer 14. The third embodiment can provide the same effect as described in connection with the first embodiment of FIGS. 1 and 2. Furthermore, it can eliminate the need for the projection 7 used in the first embodiment and the projection 12 used in the second embodiment. Additionally, it permits the use of a straw having a length shorter than the length l of the container 1.

Figure 6:
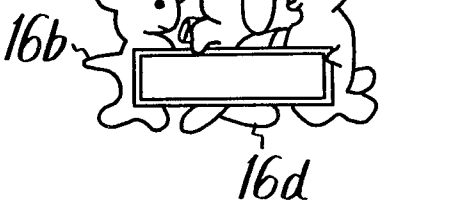
FIG. 6 shows an example of attachments for connection to the straw.

FIG. 6 illustrates an example of attachments which may be connected to the upper end of the straw so as to permit drinking with great pleasure if used in juvenile applications. The attachment 16 is contoured in the shapes of an elephant, little bear and rabbit. The trunk 16*a* of the elephant, the head 16*b* of the little bear, and the ear 16*c* of the rabbit communicate with an opening 16*d* for connection to the straw so that the beverage can be sucked, for example, through the trunk 16*a* of the elephant.

The present invention has been described in detail with reference to preferred embodiments thereof, but it will be understood that alternatives, modifications and variations can be effected within the spirit and scope of the invention. For example, the upper end closure may have a panel at least partially circumscribed by a score line which is ruptured to form a pour opening in the upper end closure. Accordingly, it is intended to embrance all alternatives, modifications and variations that fall within the spirit and broad scope of the appended claims.

What is claimed is:

1. In a beverage container arrangement including:

(a) a hollow container with upper and lower end closures, having a pour opening at the top, a cover panel to close said pour opening, said upper end closure being removably attached to said cover panel;

(b) a straw with upper and lower portions, having formed in its upper portion a stretchable structure and being provided on its lower portion with a float made of a material of a lesser specific gravity than water, said straw being longitudinally disposed in said container for outward popping movement through said pour opening;

(c) a retainer removably fitted in the straw to retain said straw within the inner part of the container so that said straw pops outwardly through said pour opening when said cover panel is removed;

the improvement which comprises:

(d) said retainer being provided with a hook-shaped cross section with an inner diameter slightly larger than the diameter of said straw and with an outer diameter smaller than the diameter of said float and attached to the inner surface of said container; and, (e) said retainer having a free end which is opened so as to easily remove said straw from said retainer by movement of said straw in the horizontal direction.

2. A beverage container arrangement as claimed in claim 1, wherein said straw is made of material not harmful from the standpoint of food sanitation, said stretchable structure being provided by a bellow portion made of the same material as the straw.

3. A beverage container arrangement as claimed in claim 1, wherein said straw is of a length substantially equal to the length between said upper and lower end closures when contained and contracted in the container and has a length longer than the distance between said end closure when the cover panel is removed and the straw pops out through said pour opening; and, the upper portion thrusts at said container upper end closure and said retainer with a constant pressure, being made of a stretchable structure at its upper portion while being contained and contracted in the container so that the straw pops out through said pour opening owing to the release of said constant pressure, because of said pressure as well as by the pressure provided by the float when said cover panel is removed.

* * * * *